US007943789B2

(12) United States Patent
Goldsberry, III et al.

(10) Patent No.: US 7,943,789 B2
(45) Date of Patent: May 17, 2011

(54) ALKENYLSUCCINIC ANHYDRIDE COMPOSITION AND METHOD OF USING THE SAME

(75) Inventors: Harold A. Goldsberry, III, Kennesaw, GA (US); Kimberly C. Dilts, Beacon Falls, CT (US); Charles R. Hunter, Winchester, VA (US); Michael P. O'Toole, Cheshire, CT (US); Robert J. Proverb, Woodbury, CT (US); Lucyna Pawlowska, Norwalk, CT (US); Glenn E. Baikow, Allentown, PA (US); Katarzyna Komarowska, Alpharetta, GA (US); David L. Dauplaise, Stamford, CT (US); Michael J. Scanlon, Newton, CT (US)

(73) Assignee: Kemira OYJ (FI)

( * ) Notice: Subject to any disclaimer, the term of this patent is extended or adjusted under 35 U.S.C. 154(b) by 238 days.

(21) Appl. No.: 10/533,702

(22) PCT Filed: Dec. 17, 2003

(86) PCT No.: PCT/US03/40271

§ 371 (c)(1),
(2), (4) Date: May 3, 2005

(87) PCT Pub. No.: WO2004/059080

PCT Pub. Date: Jul. 15, 2004

(65) Prior Publication Data

US 2006/0049377 A1 Mar. 9, 2006

Related U.S. Application Data

(60) Provisional application No. 60/434,213, filed on Dec. 17, 2002.

(51) Int. Cl.
*C07D 307/60* (2006.01)

(52) U.S. Cl. ..... 549/255; 549/233; 106/238

(58) Field of Classification Search ..... 549/233, 549/255; 106/238; 252/8.83
See application file for complete search history.

(56) References Cited

U.S. PATENT DOCUMENTS

| | | | | |
|---|---|---|---|---|
| 3,102,064 | A | 8/1963 | Wurzburg et al. | 162/158 |
| 3,445,330 | A | 5/1969 | Kulick et al. | |
| 3,770,372 | A | 11/1973 | Luvisi et al. | |
| 3,821,069 | A | 6/1974 | Wurzburg | 162/158 |
| 3,968,005 | A | 7/1976 | Wurzburg | 162/158 |
| 3,992,345 | A | 11/1976 | Dumas | |
| 4,040,900 | A * | 8/1977 | Mazzarella et al. | 162/158 |
| 4,222,820 | A | 9/1980 | Hiskens et al. | 162/158 |
| 4,235,629 | A | 11/1980 | Marsh et al. | 75/211 |
| 4,533,434 | A | 8/1985 | Yoshioka et al. | |
| 4,545,855 | A | 10/1985 | Sweeney | |
| 4,606,773 | A | 8/1986 | Novak | |
| 4,657,946 | A | 4/1987 | Rende et al. | 523/402 |
| 4,666,523 | A | 5/1987 | Yokota et al. | 106/213 |
| 4,687,519 | A | 8/1987 | Trzasko et al. | 106/211 |
| 4,695,401 | A | 9/1987 | Sweeney | |
| 4,711,671 | A | 12/1987 | Mazzarella et al. | |
| 4,728,366 | A | 3/1988 | Mazzarella et al. | |
| 4,747,910 | A | 5/1988 | Mazzarella et al. | |
| 4,769,081 | A * | 9/1988 | Maher | 127/33 |
| 4,784,727 | A | 11/1988 | Schroer et al. | |
| 4,832,792 | A | 5/1989 | Mazzarella et al. | 162/158 |
| 4,849,055 | A | 7/1989 | Yoshioka et al. | |
| 4,849,131 | A | 7/1989 | Sweeney | 252/312 |
| 4,872,951 | A | 10/1989 | Maliczyszyn et al. | 162/135 |
| 4,915,786 | A | 4/1990 | Sweeney | |
| 5,015,500 | A | 5/1991 | Garde | 427/211 |
| 5,104,486 | A * | 4/1992 | Sweeney | 162/158 |
| 5,219,912 | A | 6/1993 | Takahashi et al. | 524/321 |
| 5,224,993 | A | 7/1993 | Takahashi et al. | 196/287.2 |
| 5,306,757 | A | 4/1994 | Hatanaka et al. | 524/321 |
| 5,312,333 | A | 5/1994 | Churinetz et al. | 604/57 |
| 5,415,631 | A | 5/1995 | Churinetz et al. | 604/57 |
| 5,472,485 | A * | 12/1995 | Pandian et al. | 106/203.3 |
| 5,510,003 | A | 4/1996 | Colasurdo et al. | |
| 5,595,631 | A * | 1/1997 | Tsai et al. | 162/175 |

(Continued)

FOREIGN PATENT DOCUMENTS

EP 0257772 A1 3/1988

(Continued)

OTHER PUBLICATIONS

Smook, Gary A., Handbook for Pulp and Paper Technologists, 2nd ed, Angus Wilde Publications, 1992, p. 283.*

(Continued)

*Primary Examiner* — Matthew J Daniels
*Assistant Examiner* — Dennis Cordray
(74) *Attorney, Agent, or Firm* — Cantor Colburn LLP

(57) ABSTRACT

The invention relates to an aqueous sizing composition comprising (a) an emulsion comprising an alkenylsuccinic anhydride component containing alkenylsuccinic anhydride particles suspended in a first starch component containing emulsifying starch selected from the group consisting of non-ionic starches, ionic starches, and mixtures thereof, and (b) a second starch component selected from the group consisting of non-ionic starches, ionic starches and mixtures thereof, such that the alkenylsuccinic anhydride and the starch in the emulsion and the second starch component are present at a starch: alkenylsuccinic anhydride weight ratio that is sufficiently high to enable the sizing composition to impart useful sizing properties to a fibrous substrate when the sizing composition contacts the fibrous substrate. The invention also relates to fibrous substrates treated with the sizing composition, processes for making the composition and processes for using such a composition, and other compositions. In one embodiment, alkylene ketene dimer is used instead of alkenylsuccinic anhydride.

12 Claims, No Drawings

U.S. PATENT DOCUMENTS

| | | | | |
|---|---|---|---|---|
| 5,627,224 | A | 5/1997 | Lyrmalm et al. | 524/52 |
| 5,653,915 | A * | 8/1997 | Pardikes | 516/67 |
| 5,723,179 | A | 3/1998 | Wong et al. | 427/258 |
| 5,756,646 | A | 5/1998 | Nasu et al. | |
| 5,759,249 | A | 6/1998 | Wasser | 106/209.1 |
| 5,766,417 | A | 6/1998 | Brungardt | 162/158 |
| 5,846,663 | A | 12/1998 | Brungardt et al. | 428/537.5 |
| 5,876,562 | A | 3/1999 | Johansson | 162/158 |
| 5,931,225 | A | 8/1999 | Nishishita et al. | 165/153 |
| 5,969,011 | A | 10/1999 | Frolich et al. | |
| 5,972,100 | A * | 10/1999 | Dumas | 106/501.1 |
| 6,001,166 | A | 12/1999 | Ettl et al. | |
| 6,048,392 | A | 4/2000 | Brungardt et al. | 106/287.21 |
| 6,093,217 | A * | 7/2000 | Frolich et al. | 8/115.6 |
| 6,159,339 | A | 12/2000 | Hasslet et al. | 162/158 |
| 6,162,328 | A | 12/2000 | Cenisio et al. | 162/135 |
| 6,165,259 | A * | 12/2000 | Hallstrom et al. | 106/243 |
| 6,183,550 | B1 * | 2/2001 | Conner et al. | 106/209.1 |
| 6,207,719 | B1 | 3/2001 | Pardikes | 516/67 |
| 6,210,475 | B1 * | 4/2001 | Dauplaise et al. | 106/209.1 |
| 6,248,164 | B1 | 6/2001 | Hakansson | 106/287.2 |
| 6,296,696 | B1 * | 10/2001 | Letourneau et al. | 106/287.2 |
| 6,325,893 | B1 | 12/2001 | Brungardt et al. | 162/158 |
| 6,346,554 | B1 | 2/2002 | Dostie et al. | |
| 6,348,132 | B1 | 2/2002 | Zhang et al. | 162/158 |
| 6,372,035 | B1 | 4/2002 | Juppo et al. | 106/287.2 |
| 6,444,024 | B1 | 9/2002 | Mills et al. | 106/287.23 |
| 6,576,049 | B1 * | 6/2003 | Dilts et al. | 106/219 |
| 6,666,952 | B2 | 12/2003 | Dilts et al. | |
| 2001/0049397 | A1 | 12/2001 | Pardikes | 516/67 |
| 2003/0205167 | A1 * | 11/2003 | Dilts et al. | 106/219 |
| 2005/0124704 | A1 * | 6/2005 | Rasheed et al. | 516/53 |
| 2006/0037512 | A1 | 2/2006 | Pawlowska et al. | |
| 2006/0060814 | A1 | 3/2006 | Pawlowska et al. | |
| 2009/0277355 | A1 | 11/2009 | Pawlowska et al. | |
| 2009/0281212 | A1 | 11/2009 | Pawlowska et al. | |

FOREIGN PATENT DOCUMENTS

| | | |
|---|---|---|
| GB | 1296511 | 7/1974 |
| GB | 2148910 | 6/1985 |
| JP | 61274735 | 5/1985 |
| JP | 61034298 | 2/1986 |
| JP | 05195488 | 8/1993 |
| JP | 06116894 | 4/1994 |
| JP | 06128896 | 5/1994 |
| JP | 1992-349863 | 6/1994 |
| JP | 06166985 | 6/1994 |
| JP | 09111692 | 4/1997 |
| JP | 09228293 | 9/1997 |
| JP | 2000265389 | 9/2000 |
| WO | 97/05330 | 2/1997 |
| WO | 9730218 | 8/1997 |
| WO | 97/49865 | 12/1997 |
| WO | 98/32920 | 7/1998 |
| WO | 00/20686 | 4/2000 |
| WO | 01/00927 | 1/2001 |
| WO | 01/38638 | 5/2001 |
| WO | 01/88262 A2 | 11/2001 |
| WO | 02/08514 | 1/2002 |
| WO | 02/35003 | 5/2002 |

OTHER PUBLICATIONS

Ying et al., "Effect of Cationic Starch on the Emulsification of ASA", China National Pulp and Paper Research Institute, No. 5, 2002 (9 pages).

Cao Chunyu, "Alkenyl Succinic Anlydrides (ASA): a Neutral sizing agent", China National Pulp and Paper Research Institute, No. 3, 2002 (11 pages).

International Search Report; International Application No. PCT/US03/40271; Date of Mailing Jun. 4, 2004.

DE 31 05 903, Publication date: Sep. 9, 1982, Abstract, 1 page.

Cates et al., Alkyl Ketene Dimer Sizes, Chapter 2 in The Sizing of Paper, 2nd Edition, W.F. Reynolds, Ed., Tappi Press, 1989, pp. 33-50.

Davis et al., TAPPI 39 (1), 21 (1956).

The Sizing of Paper, Second Edition, edited by W.F. Reynolds, TAPPI Press, 1989, pp. 51-62.

Zandersons J. G., et al, "Gelatinized unmodified starch-stabilized alkenyl succinic anhydride emulsion paper sizing", pp. 109-113, (Russian journal not available).

United States Patent Office, U.S. Appl. No. 10/534,202, Non-Final Office Action dated: Dec. 4, 2007, 7 pages.

United States Patent Office, U.S. Appl. No. 10/534,202, Non-Final Office Action dated: Jun. 16, 2008, 12 pages.

United States Patent Office, U.S. Appl. No. 10/534,202, Non-Final Office Action dated: Jun. 16, 2008, 12 pages.

United States Patent Office, U.S. Appl. No. 12/505,578, Non-Final Office Action dated: Mar. 2, 2010, 8 pages.

United States Patent Office, U.S. Appl. No. 10/533,190, Non-Final Office Action/Restriction Requirement dated: Sep. 24, 2007, 8 pages.

United States Patent Office, U.S. Appl. No. 10/533,190, Non-Final Office Action dated: Dec. 5, 2007, 33 pages.

United States Patent Office, U.S. Appl. No. 10/533,190, Final Office Action dated: Aug. 20, 2008, 19 pages.

United States Patent Office, U.S. Appl. No. 10/533,190, Non-Final Office Action dated: Jan. 21, 2009, 24 pages.

United States Patent Office, U.S. Appl. No. 12/505,753, Non-Final Office Action dated: May 17, 2010, 20 pages.

* cited by examiner

ALKENYLSUCCINIC ANHYDRIDE COMPOSITION AND METHOD OF USING THE SAME

This application is a 371 of PCT/US03/40271, filed Dec. 17, 2003 and claims the benefit of U.S. Provisional Application No. 60/434,213, filed Dec. 17, 2002.

BACKGROUND

Papermakers would benefit from a simple, effective, starch-based, cellulose-reactive surface-applied sizing agent system that (i) imparts useful sizing properties to fibrous substrates and (ii) reduces or eliminates the need to use sizing agents at the wet end of a papermaking process. Unfortunately, known methods and compositions have prevented papermakers from achieving this goal.

It is well known that the property of sizing, as applied to paper, refers to a fibrous substrate's ability to resist wetting or penetration of a liquid into a paper sheet. Aqueous dispersions of alkenylsuccinic anhydride (ASA) cellulose-reactive sizing agent have been widely used in the paper and board making industry for many years, for sizing a wide variety of grades which include printing and writing grades and bleached and unbleached board grades. Cellulose-reactive alkenylsuccinic anhydride emulsions impart hydrophobic properties to the paper and board products.

Chemicals used to achieve sizing properties are known as either internal sizes or surface sizes. Internal sizes can be either rosin-based or synthetic sizes such as alkenylsuccinic anhydride, or other materials. Internal sizes are added to the paper pulp prior to sheet formation. Surface sizes are sizing agents that are added after the paper sheet has formed, most generally at the size press, although spraying applications may also be used.

Alkenylsuccinic anhydride sizing agent is ordinarily applied by dispersing it in a cationic or amphoteric hydrophilic substance such as a starch or a polymer. The starch or polymer-dispersed alkenylsuccinic anhydride sizing emulsions have been added to the pulp slurry before the formation of a paper web. This type of addition of alkenylsuccinic anhydride sizing emulsions to the papermaking system is commonly called wet-end addition or internal addition of alkenylsuccinic anhydride.

Unfortunately, the addition of alkenylsuccinic anhydride to the wet end of the papermaking machine has several disadvantages. Internally added alkenylsuccinic anhydride emulsions are never totally retained on the fiber. The portion that is not retained is free to react with water or other components of the papermaking system and can form deposits at the wet-end of the paper machine, or can then be carried to the press or drying sections of the paper machine and form paper or board defects. Further, internal addition of alkenylsuccinic anhydride emulsions has the potential for interacting with other wet-end additives, such as brightening agents, defoamers or dispersants, biocides, dyes, strength agents, etc.

Further, increases in filler addition, such as calcium carbonate filler at the wet-end of the paper making system have led to an increase in size demand as well. Filler particles have a relatively high surface area as compared to cellulose fiber and readily adsorb internally added sizing agents. Alkenylsuccinic anhydride, which is adsorbed onto calcium carbonate filler particles, leads to a less efficient sizing, requiring higher doses as compared to treatment of unfilled paper webs sized with cellulose reacted alkenylsuccinic anhydride sizing agent.

Efforts to develop compositions and methods that surface treat fibrous substrates have failed to produce a simple, effective starch-based system that imparts useful sizing properties to a fibrous substrate and that reduces or eliminates the need to use sizing agents at the wet end of a papermaking process. For example, conventional surface sizes, styrene acrylate emulsions, styrene acrylics, styrene maleic anhydrides, polyurethanes and the like require an internal size to be efficient.

U.S. Pat. No. 6,162,328 discloses a method for sizing paper that adds a sizing composition containing mixtures of cellulose-reactive and cellulose non-reactive size dispersions to the surface of the paper. The cellulose non-reactive sizes are polymeric materials such as copolymers of styrene or substituted styrenes with vinyl monomers containing carboxyl groups. Cellulose-reactive sizes include sizes such as ketene dimers and multimers, alkenylsuccinic anhydrides, organic epoxides, acyl halides, fatty acid anhydrides from fatty acids and organic isocyanates. The starch may be of any type, including but not limited to oxidized, ethylated, cationic and pearl starch, and is preferably used in aqueous solution. The cellulose-reactive size dispersions and non-reactive size dispersions may be added with a solution of starch or starch derivative before being applied to the paper.

U.S. Pat. No. 6,162,328 requires the combination of at least one cellulose-reactive size and at least one cellulose non-reactive size. This combination allows one to add alkenylsuccinic anhydride or alkyl ketene dimer to the size press by balancing properties of both types. The requirement that combinations of polymeric materials be used makes the composition more expensive and complicated as compared to single sizing component addition. Further, it does not include any criticality in the ratio of starch to the cellulose-reactive size.

U.S. Pat. No. 4,872,951 discloses blends of alkenylsuccinic anhydride-treated and cationic starches for use as external sizes of paper and paperboard products. The blends contain 30-90% (by wt.) of the alkenylsuccinic anhydride-treated starch, which is a monoester of the starch and an alkyl- or alkenylsuccinate and 10-70% (by wt.) cationic starch. The invention requires a reaction product of starch with alkenylsuccinic anhydride combined with cationic starch, which is added to the surface of the paper. Manufacturing this reaction product is an additional process step. In addition, the document's emphasis on cationic starches does not teach how non-ionic and anionic starches could be used in emulsions to effectively deliver alkenylsuccinic anhydride to a fibrous substrate and impart useful sizing properties.

WO 02/08514 describes the preparation of a sizing emulsion that contains a sizing agent, and an inorganic particulate emulsifying agent capable of forming an emulsion and water. The sizing agent can be 2-oxetanone dimer or multimer, alkenylsuccinic anhydride, rosin or carbamoyl chloride. The inorganic particulate emulsifying agent is selected from clay, silica, zeolite, mica, calcium carbonate, phosphate or sulfate; aluminum oxide, hydroxide, phosphate or silicate; magnesium phosphate or silicate; polyaluminum chloride, phosphate or silicate and ferrous or ferric phosphate, silicate or oxide. According to the patent, the addition of the inorganic particulate emulsifying agent allows one to add alkenylsuccinic anhydride to the size press. Example 28, a comparative example, discloses that a conventionally prepared alkenylsuccinic anhydride "emulsion comprising surfactant and starch does not work in the size press . . . "

For the foregoing reasons, there is a need to develop a method that avoids the deposits that are often associated with internally added alkenylsuccinic anhydride sizing agents or ketene dimer sizing agents to the papermaking processes.

For the foregoing reasons, there is a need to develop sizing compositions that provide for nearly 100% retention onto the surface of the preformed fiber web.

For the foregoing reasons, there is a need to develop a surface applied alkenylsuccinic anhydride sizing system that is more efficient than an internally applied alkenylsuccinic anhydride sizing system.

For the foregoing reasons, there is a need to develop sizing compositions that impart useful sizing properties to a fibrous substrate when the sizing compositiontreats a fibrous substrate.

SUMMARY

The invention relates to an aqueous sizing composition comprising (a) an emulsion comprising an alkenylsuccinic anhydride component containing alkenylsuccinic anhydride particles suspended in a first starch component containing emulsifying starch selected from the group consisting of non-ionic starches, cationic starches, anionic starches, and mixtures thereof, and (b) a second starch component selected from the group consisting of non-ionic starches, cationic starches, anionic starches and mixtures thereof, such that the alkenylsuccinic anhydride component and the starch in the emulsion and the second starch component are present at a starch:alkenylsuccinic anhydride component weight ratio that is sufficiently high to enable the sizing composition to impart useful sizing properties to a fibrous substrate when the sizing composition contacts the fibrous substrate.

The invention also relates to a method for making a sizing composition comprising the sequential steps of (a) emulsifying alkenylsuccinic anhydride with a first starch component containing starch selected from the group consisting of non-ionic starches, anionic starches, cationic starches and mixtures thereof, and thereby forming an emulsion, and (b) combining the emulsion with a second starch component selected from the group consisting of non-ionic starches, ionic starches, and mixtures thereof, and thereby forming an aqueous sizing composition comprising (a) an emulsion comprising alkenylsuccinic anhydride component containing alkenylsuccinic anhydride particles suspended in a first starch component containing emulsifying starch selected from the group consisting of non-ionic starches, ionic starches, and mixtures thereof, and (b) a second starch component selected from the group consisting of non-ionic starches, ionic starches and mixtures thereof, such that the alkenylsuccinic anhydride component and the starch in the emulsion and the second starch component are present at a starch:alkenylsuccinic anhydride component weight ratio that is sufficiently high to enable the sizing composition to impart useful sizing properties to a fibrous substrate when the sizing composition contacts the fibrous substrate.

In one embodiment, the invention relates to an aqueous sizing composition comprising: (a) an emulsion comprising an alkyl ketene dimer component containing alkyl ketene dimer particles suspended in a first starch component containing emulsifying starch selected from the group consisting of non-ionic starches, cationic starches, anionic starches, and mixtures thereof, and (b)a second starch component selected from the group consisting of non-ionic starches, cationic starches, anionic starches and mixtures thereof, such that the alkyl ketene dimer component and the starch in the emulsion and the second starch component are present at a starch: alkyl ketene dimer weight ratio that is sufficiently high to enable the sizing composition to impart useful sizing properties to a fibrous substrate when the sizing composition contacts the fibrous substrate.

The invention also relates to a method for sizing with the sizing composition of this invention.

These and other features, aspects, and advantages of the present invention will become better understood with reference to the following description and appended claims.

DESCRIPTION

The invention is based on the remarkable discovery that by emulsifying alkenylsuccinic anhydride with starch, forming an emulsion, and then adding a starch component to the emulsion under carefully controlled conditions, it is now possible to make a simple, yet highly effective sizing composition that imparts useful sizing properties to a fibrous substrate when the sizing composition contacts the fibrous substrate at a size press. The invention is also based on the discovery that even if the sizing composition made in accordance to the invention contains hydrolyzed alkenylsuccinic anhydride (HASA), the sizing composition can impart useful sizing properties to fibrous substrates so long as the starch to alkenylsuccinic anhydride size ratio is sufficiently high. Advantageously, the use of the sizing composition reduces or eliminates deposition or sticking at the size press, calendar stack, or drying section of a paper machine.

The phrase "useful sizing properties" as used herein, means sizing properties that are useful for a paper product's intended use. Conversely, the phrase "useless sizing properties" as used herein, means sizing properties of that are not useful for a paper product's intended use. The term "emulsion" as used herein refers to emulsions made in accordance with the invention, which when combined with an additional starch component, forms a sizing composition that is particularly useful when applied at any location in a papermaking process after which a fibrous sheet has formed, e.g., a size press or coater.

The invention relates to an aqueous sizing composition that includes (a) an emulsion containing an alkenylsuccinic anhydride component containing alkenylsuccinic anhydride particles suspended in a first starch component containing emulsifying starch selected from the group consisting of non-ionic starches, ionic starches, and mixtures thereof, and (b) a second starch component selected from the group consisting of non-ionic starches, cationic starches, anionic starches and mixtures thereof. The alkenylsuccinic anhydride component and the starch in the emulsion and the second starch component are present at a starch:alkenylsuccinic anhydride component weight ratio that is sufficiently high to enable the sizing composition to impart useful sizing properties to a fibrous substrate when the sizing composition contacts the fibrous substrate. In one embodiment, alkyl ketene dimer is used instead of alkenyl succinic anhydride. In another embodiment, mixtures of alkenylsuccinnic anhydride and alkyl ketene dimer are used.

The sizing composition of the invention is specially designed for use at size presses. The sizing composition of this invention reduces or eliminates the need for the use of sizing agents at the wet end of a papermaking process.

The first starch component used to make the emulsion generally includes any starch that can emulsify alkenylsuccinic anhydride and form an emulsion that can be combined with additional starch to form a sizing composition in accordance to the invention. Generally, the first starch component includes starches that have been modified and are generally anionic or non-ionic in nature. However, the first starch component can include amphoteric or cationic starches, e.g., starches that are also used in size presses.

Suitable starches are typically anionic or nonionic, and may include those where the base corn, potato, wheat, tapioca or sorghum-based starch is modified through the use of enzymes, high temperatures, and or chemical/thermal converting techniques. Chemical modifications include but are not limited to oxidation, acid modification, heat, acetylation, and hydroxyethylation. Examples of suitable starches include but are not limited to Penford's Douglas® 3012 oxidized dent corn starch, Cargill's Filmflex® 60 hydroxyethylated dent corn starch, and Staley's Ethylex® 2035 hydroxyethylated dent corn starch.

The starch can be used in the form of an aqueous starch solution. The viscosity of a starch solution can vary from about 10 cP to about 200 cP at a typical size press solution temperature. Advantageously, typical hot starch temperatures can be used for emulsification and the sizing composition containing the emulsion can still impart useful sizing properties. The starch temperature can vary from about 60 to about 200° F. (from about 15 to about 93° C.). The starch solids need also not be modified, but can be if desired. The starch solids can range from about 1 to about 20 wt. %, and preferably from about 5 to about 13 wt. %. In one embodiment, cationic starches used for wet end emulsification can be acidified to a pH ranging from about 4.0 to about 7, or preferably from about 4.0 to about 5.0. The pH of the first starch component can be used at its autogenous pH. The pH can but does not need to be adjusted. The pH of the starch component is generally from about 5 to 9, or preferably from about 7 to about 8.5.

The first starch component is used in an amount that is sufficient to make an emulsion in accordance with the invention. Generally, the first starch component is present in the emulsion at a starch:alkenylsuccinic anhydride component weight ratio that is at least about 0.2:1. In one embodiment, the first starch component is generally present in the emulsion at a starch:alkenylsuccinic anhydride component weight ratio that ranges from about 0.2:1 to about 10:1, preferably from about 0.2:1 to about 7:1, or preferably from about 0.5:1 to about 2:1. In another embodiment, the first starch component is generally present in the emulsion at a starch:alkenylsuccinic anhydride component weight ratio that ranges from about 0.2:1 to about 20:1.

The alkenylsuccinic anhydride component generally includes alkenylsuccinic anhydride compounds composed of mono unsaturated hydrocarbon chains containing pendant succinic anhydride groups. The alkenylsuccinic anhydride compounds are generally liquid and may be derived from maleic anhydride and suitable olefins. The alkenylsuccinic anhydride compounds may be solid.

Generally speaking, the alkenylsuccinic anhydride compounds may be made by reacting an isomerized $C_{14}$-$C_{20}$ mono olefin, preferably an excess of an internal olefin, with maleic anhydride, at a temperature and for a time sufficient to form the alkenylsuccinic anhydride compound.

If the olefin to be employed in the preparation of the alkenylsuccinic anhydride compounds is not an internal olefin as is the case for example, with α-olefins, it may be preferable to first isomerize the olefins to provide internal olefins. The olefins that may be used in the preparation of the alkenylsuccinic anhydride compounds may be linear or branched. Preferably, the olefins may contain at least about 14 carbon atoms. Typical structures of alkenylsuccinic anhydride compounds are disclosed, for example, in U.S. Pat. No. 4,040,900, incorporated herein by reference in its entirety. Alkenylsuccinic anhydride compounds and methods for their preparation are described, for example, in C. E. Farley and R. B. Wasser, "The Sizing of Paper, Second Edition," edited by W. F. Reynolds, TAPPI Press, 1989, pages 51-62, the disclosures of which are hereby incorporated herein by reference in its entirety.

The alkenylsuccinic anhydride component may contain some hydrolyzed alkenylsuccinic anhydride. The amount of hydrolyzed alkenylsuccinic anhydride (HASA) may range from about 1 to about 99 wt. %, based on the total weight of the alkenylsuccinic anhydride component.

The alkenylsuccinic anhydride component is generally present in the emulsion in an amount that is at least about 0.01 wt. %, or from about 0.1 to about 20 wt. %, or from about 0.3 wt. % to about 15 wt. %, based on the total weight of the emulsion.

The emulsion is generally made by emulsifying a suitable amount of alkenylsuccinic anhydride with a suitable amount of starch under conditions that produce an emulsion, which when combined with the second starch component, forms a sizing composition that imparts useful sizing properties to a fibrous substrate during or after the sizing composition contacts a fibrous substrate.

Preferably, the emulsion is made by passing the alkenylsuccinic anhydride and a suitable amount of starch solution at a suitable starch:alkenylsuccinic anhydride component weight ratio through a shearing device that provides sufficient energy to form an emulsion. The alkenylsuccinic anhydride should not be exposed to water before emulsification process and the starch should be completely cooked. Uncooked starch particles may result in poor emulsion quality due to the fact that uncooked particles may lead to coalescence as well as result in mechanical wear to the shearing device.

The pressure and temperature at which the emulsion is made are sufficient to make an emulsion that can be combined with the second starch component and form a sizing composition that imparts useful sizing properties to a fibrous substrate when the sizing composition contacts the fibrous substrate. In one embodiment the inlet pressure of a suitable emulsification device, e.g., a shearing device, is about 10 psig at a temperature ranging from about 120 to about 150° F. (from about 48 to about 66° C.), and the outlet pressure ranges from about 150 to about 160 psig at a temperature ranges from about 130 to about 160° F. (from about 54 to about 71° C.). The primary starch flow to a suitable shearing device, e.g., a Burks pump, can range from about 0.8 to about 2.0 gallon per minute (gpm), preferably about 1.5 gpm, and most preferably about 1.0 gpm.

In one embodiment, the emulsion is made from an alkenylsuccinic anhydride component that further contains a surfactant component. The surfactant component facilitates the emulsification of the alkenylsuccinic anhydride with the first starch component when the emulsion is made. Generally, the surfactants are anionic or nonionic or can be cationic and can have a wide range of HLB values.

Examples of suitable surfactants include but are not limited to alkyl and aryl primary, secondary and tertiary amines and their corresponding quaternary salts, sulfosuccinates, fatty acids, ethoxylated fatty acids, fatty alcohols, ethoxylated fatty alcohols, fatty esters, ethoxylated fatty esters, ethoxylated triglycerides, sulfonated amides, sulfonated amines, ethoxylated polymers, propoxylated polymers or ethoxylated/propoxylated copolymers, polyethylene glycols, phosphate esters, phosphonated fatty acid ethoxylates, phosphonated fatty alcohol ethoxylates, and alkyl and aryl sulfonates and sulfates. Examples of preferred suitable surfactants include but are not limited to amides; ethoxylated polymers, propoxylated polymers or ethoxylated/propoxylated copolymers; fatty alcohols, ethoxylated fatty alcohols, fatty esters, carboxylated alcohol or alkylphenol ethoxylates; carboxylic acids; fatty acids; diphenyl sulfonate derivatives; ethoxylated alcohols; ethoxylated fatty alcohols; ethoxylated alkylphenols; ethoxylated amines; ethoxylated amides; ethoxylated aryl phenols; ethoxylated fatty acids; ethoxylated triglycerides; ethoxylated fatty esters; ethoxylated glycol esters; polyethylene glycols; fatty acid esters; glycerol esters; glycol esters; certain lanolin-based derivatives; monoglycerides, diglycerides and derivatives; olefin sulfonates; phosphate esters; phosphorus organic derivatives; phosphonated fatty acid ethoxylates, phosphonated fatty alcohol ethoxylates; polyethylene glycols; polymeric polysaccharides; propoxylated and ethoxylated fatty acids; alkyl and aryl sulfates and sulfonates; ethoxylated alkylphenols; sulfosuccinamates; sulfosuccinates.

In one embodiment, the surfactant component includes an amine selected from the group consisting of trialkyl amine of the formula (I):

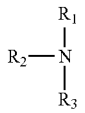

dimethyl sulfate quaternary salt of trialkyl amine of the formula (I), benzyl chloride quaternary salt of trialkyl amine of the formula (I), and diethyl sulfate quaternary salt of trialkyl amine of the formula (I), in which $R_1$ is methyl or ethyl, $R_2$ is methyl or ethyl, and $R_3$ is alkyl having 14 to 24 carbon atoms. In another embodiment, the surfactant excludes this amine. The surfactant levels can range from about 0.1 weight % up to about 20 weight % based on the alkenylsuccinic anhydride component.

The particles of the emulsion generally have a median particle size that is about 0.5 microns or higher. The median particle size of the emulsion can vary, depending on the application, the type of starch used for emulsification, and the starch properties. In one embodiment, the median particle size of the emulsion ranges from about 0.1 to about 50 microns, or from about 0.5 to about 30 microns. It will be appreciated that the particles suspended by the emulsifying starch can exhibit a wide range of particle distributions. The ability to use an emulsion having such a wide range of particle distributions is advantageous, because they are easier to prepare. It is generally recognized that emulsions used in wet end applications require relatively narrower and smaller particle size distributions to provide effective sizing. Preparing emulsions having such relatively narrower and small particle size distributions, (customarily prepared to apply alkenylsuccinic anhydride at the wet end) can be demanding from starch quality perspective. The particle size distribution of the emulsion of this invention is preferably mono-modal. However, in some cases, the distribution can be bimodal or multimodal.

The second starch component that is combined with the emulsion to form the sizing composition can generally be any starch, which when combined with the emulsion, enables the formation of a sizing composition in accordance to the invention. Generally, the starches in the second starch component are the same starches that are used in the first starch component. In one embodiment, the first starch component and the second starch component are both obtained from the size press starch solution. Unlike the first starch component, the second starch component is generally used in an amount that is more than the amount of starch in the first starch component. The use of the second starch component in this invention is critical.

The sizing composition is made by combining the emulsion with the second starch component. The emulsion can be combined with the second starch component by any suitable means, e.g., by mixing. Preferably, the emulsion and the second starch component are combined in-line. When the emulsion is made a temperature that is less than about 40° C., the emulsion is generally heated by the second starch component when the emulsion is combined with the second starch component, such that the temperature of the resulting sizing composition ranges from more than about 40° F., e.g. from more than about 40 to about 200° F. (about 94° C.) or 150° F. (from about 4 C to about 66° C.), or from about 55 to about 100° F. (from about 13° C. to about 38° C.). Alternatively, when the emulsion is made at a temperature that is more than above about 40° F., the temperature of the resulting aqueous sizing composition is also generally more than above 40° F., e.g. from more than about 40° F., or 50° F. (10° C.) to about 200° F. (about 94° C.). When the emulsion is made at a temperature that, is more than above about 40° F., the temperature of the emulsion is generally lower than the temperature of the second starch component before it is combined with the second starch component. In one embodiment, when the first component is made at a temperature that is more than above about 40° F., the temperature of the first component is the same or greater than the temperature of the second starch component before it is combined with the second starch component. As such, the emulsion is not added directly to a surface of a fibrous substrate, but rather the emulsion is combined with the second starch component to form an aqueous sizing composition under conditions that would be expected to cause hydrolysis, and then the resulting sizing composition is added to the fibrous substrate.

The sizing composition preferably has a starch:alkenylsuccinic anhydride component weight ratio that is sufficiently high to enable the sizing composition to minimize coalescing at papermaking operating conditions and to impart useful sizing properties to a fibrous substrate when the sizing composition contacts the fibrous substrate. The starch:alkenylsuccinic anhydride component weight ratio is critical, because if the sizing composition recirculates in the system over time and the starch:alkenylsuccinic anhydride weight ratio is not sufficiently high, the sizing composition may unduly coalesce.

Generally, the emulsion and the second starch component of the sizing composition have a starch:alkenylsuccinic anhydride component weight ratio that is at least about 10:1. The ranges of the starch:alkenylsuccinic anhydride component weight ratios may range from about 10:1 or 20:1 to about 100:1 or more. In one embodiment, the starch:alkenylsuccinic anhydride component weight ratio ranges from about 10:1 to about 200:1, preferably from about 60:1 to about 120:1.

Water is the major component of the sizing composition. Generally, the water forms at least about 95 wt. %, or at least about 90 wt. % or at least about 80 wt. % of the sizing composition.

The sizing composition can contain other materials. For instance, in one embodiment, the sizing composition can contain synthetic polymers that function as stabilizers. Examples of suitable polymeric stabilizers include vinyl addition and condensation polymers having anionic, cationic, non-ionic and amphoteric charge characteristics with a charge substitution range varying from 0 to about 90%, and more preferably from 0 to about 10%. Further, the molecular weight of aforementioned synthetic polymeric stabilizer would fall into the range of from about 10,000 to about 2.0 million daltons, or from about 200,000 to about 1 million daltons. All molecular weights mentioned herein are weight average.

In another embodiment, the sizing composition further contains surface sizing agents. However, this is not necessary. Suitable surface sizing agents include but are not limited to styrene maleic anhydride copolymers, styrene acrylic acid copolymers, polyurethane dispersions and styrene acrylate emulsions. Preferred styrene maleic anhydride copolymers are copolymers of styrene or substituted styrene with vinyl monomers such as maleic anhydride and their partially esterified or hydrolyzed counterparts. An example is Baysize™ S 48. Preferred styrene acrylic acid copolymers are copolymers of styrene or substituted styrene with vinyl monomers such as acrylic acid and methacrylic acid. Examples are Baysize™ S 210 and 225. Preferred polyurethane dispersions are copolymers of isocyanate or diisocyanates and amines or alcohols. Examples are Graphsize™ A, C, and T. Preferred styrene acrylate emulsions are copolymers of styrene, substituted styrene or acrylonitrile with acrylate or methacrylate esters. Examples are Baysize™ S AGP, BMP, and 850, Basoplast™ 400DS styrene acrylate emulsion. On a dry basis, the weight ratio of the alkenylsuccinic anhydride component to the additional sizing agent ranges from about 1:0.2 to about 1:50.

In one embodiment, the sizing composition contains less than about 1 to 50 wt. % of an additional sizing agent to the alkenylsuccinic anhydride component. In other embodiments, the sizing composition contains more than about 0.5:1 wt. ratio additional sizing agent to the alkenylsuccinic anhydride component, or less than about 50:1 wt. ratio additional sizing agent to the alkenylsuccinic anhydride component.

The fibrous substrate treated with the sizing composition can be any substrate of a paper product, which when treated with the sizing composition made in accordance to the invention, acquires sizing properties that are suitable for its intended use. In one embodiment, the fibrous substrate includes bleached and unbleached paper or paperboard containing calcium carbonate, titanium dioxide and clay filled paper products. The paper product made from the fibrous substrate may include paper or board, bleached or unbleached that is treated on the surface in a size press or by spraying with a sizing composition of the invention.

The invention is particularly beneficial for sizing board products, fine paper products or newsprint paper products. Board is typically a paper machine produced fiber web of heavier weight than paper. Generally, the weight of board ranges from about 120 to about 400 grams per square meter, (gsm). Board pulps can be bleached or unbleached virgin softwood, hardwood types or be made of a blend of recycled paper composed of one or more of the following: corrugated boxes, old newsprint, mixed office waste, and old magazines, the latter two containing calcium carbonate filler. Newsprint is essentially wood-containing coated and uncoated magazine and newspaper papers made from ground wood pulp, which is pulp not chemically treated or a combination of ground wood, and recycled furnishes. Fine paper generally is referred to as printing and writing paper, excluding newsprint. Generally, the weight of fine paper ranges from about 40 to about 120 grams per square meter, (gsm). Specific applications include magazines, catalogs, books, commercial printing, copying and business forms, and stationary. The pulp used in the majority of these grades is chemically treated, with limited recycle or wood-containing pulp. Printing and writing paper are generally made from bleached chemical pulps, (e.g., kraft pulping or sulfite pulping), and contain calcium carbonate levels of from about 5 to about 30%. They may also partially contain deinked/recycled bleached waste paper, (sorted mixed office waste).

In use, the invention encompasses a process for sizing a paper product that involves (a) forming a fibrous sheet from a pulp slurry, and (b) treating a surface of the fibrous sheet with the sizing composition of this invention. The sizing composition of the invention is added to a surface of a fibrous substrate at an amount that is sufficiently high to impart useful sizing properties to the resulting paper product. The sizing composition can be added to a fibrous substrate by any way that enables the sizing composition to adsorb the sizing composition onto the surface of the fibrous substrate. The sizing composition penetrates into the fibrous substrate in an amount depended on surface applied starch pick-up. In one embodiment, the sizing composition can be applied to unbleached kraft or wood containing papers. The sizing composition is preferably made on-site and used soon after it is prepared.

In one embodiment, the sizing composition is applied onto the surface of the formed web at an alkenylsuccinic anhydride component dosage (pounds per ton of dry paper) that is at least about 0.1, or from about 0.1 to about 10, or from about 0.5 to about 5, or preferably from about 0.5 to about 3.0. Particularly advantageous dosages of the alkenylsuccinic anhydride component for making board paper products range from about 1.5 to about 3.0, preferably from about 1.5 to about 2.5 pounds per ton of dry paper. Particularly advantageous dosages for making fine paper products range from about 0.1 to about 5 pounds per ton of dry paper, or from about 0.5 to about 2.0, or preferably from about 0.5 to about 1.5 pounds per ton of dry paper. Particularly advantageous dosages for making newsprint paper products range from about 0.1 to about 5, from about 0.1 to about 3 or from about 0.1 to about 1.5. Other suitable ranges may from about about 0.1 to about 1.0, preferably from about 0.2 to about 0.7 pounds per ton of dry paper.

Stated in weight percent, the amount of the alkenylsuccinic anhydride component in the fibrous substrate can be at least about 0.005 wt. % and can range from about 0.005 to about 1 wt. %, based on weight of fibrous substrate produced, or preferably from about 0.025 to about 0.5 wt. % on the same basis.

The temperature at which the sizing composition is used is generally less than about 180° F. (about 82° C.), and can range from about 120° F. (about 49° C.) to about 180° F. (about 82° C.), or from about 140° F. (about 60° C.) to about 160° F. (about 71° C.). Due to the high ratio of starch:alkenylsuccinic anhydride component in the sizing composition, higher temperatures are possible than normally encountered in the emulsification of alkenylsuccinic anhydride in starch for internal addition. The pH condition in which the sizing composition is used is generally from about 5 to about 9, or from about 7 to about 8.

A fibrous substrate treated with a sizing composition of the invention acquires sizing properties that are appropriate for its intended use. Generally, a fine paper product made with the sizing composition will exhibit sizing properties that have at least 20 seconds of ink penetration holdout, as described in TAPPI standard method T530 om96, preferably from about 20 to about 500 seconds, or preferably from about 50 to about 200 seconds.

For board products, the sizing composition is capable of sizing a board fibrous substrate so that the resulting paper product exhibits a Cobb sizing value (based on 2 minute test) ranging from about 50 to about 120 grams per square meter, depending on end use of the board produced. Cobb sizing is a measure of the amount of liquid, generally water, which is adsorbed into the surface of a board or paper sample in a pre-stated amount of time, (in this case 2 minutes) using standardized equipment and procedures as described in TAPPI Method T441 om98. Alternatively, a board paper product made with the sizing composition can exhibit Cobb sizing values ranging from about 30 to about 120 gsm, or preferably from about 50 to about 80 gsm.

For fine paper products, the sizing composition is capable of sizing a fibrous substrate so that the resulting paper product exhibits a Cobb sizing value (based on 1 minute) ranging from about 18 to about 40 gsm. Alternatively, depending on the grade of fine paper, the invention can impart from 20 Seconds Hercules Size Test (HST, known as "TAPPI 530", 1% formic acid, 80% reflectance) to 500 seconds of resistance to penetration.

For newsprint paper products, the sizing composition is capable of sizing a fibrous substrate, and producing a resulting paper product that exhibits sizing properties ranging from about 10 to about 100 seconds, as measured by a water drop test (based on 5 μL water drop size), depending on end use of publication grades being made. Water drop test is a commonly used test in newsprint applications where the time for the water drop to penetrate into the fibrous substrate is measured.

Paper products made with the sizing composition of the invention can also contain an internally added sizing agent so that pre-size press sizing has anywhere from about 2 to about 10 seconds of HST for good size press runnability.

When it is desirable to practice a process in which some sizing agent is added to the wet end, a wet end sizing agent component is added to a pulp slurry and a fibrous sheet is formed from the slurry. The fibrous sheet is then treated with a sizing composition of the invention and the fibrous substrate is sized.

The wet end sizing agent component can include any sizing agent that is used in the wet end and, as such, includes those sizes believed to be capable of forming covalent chemical bonds by reaction with the hydroxyl groups of cellulose. Suitable sizes for use in the wet end sizing agent component include ketene dimers and multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms. Ketene dimers and multimers are known and described in U.S. Pat. No. 6,162,328, incorporated herein in its entirety.

In one embodiment, the wet end sizing agent component contains cationic starch. Suitable cationic starches include those starches that are typically used in the wet end. In another embodiment, the wet end sizing agent component contains cationic starch and alkenylsuccinic anhydride. In another embodiment, the wet end sizing component can be the emulsion used to make the sizing composition of the invention. In this embodiment, some emulsion that would ordinarily be used to make the sizing composition of this invention is reserved for use as the wet end sizing component. When cellulose-reactive sizing agents are added to the wet end and the sizing composition of the invention is used to surface treat a fibrous substrate, the weight ratio of (i) the sizing agent applied at the wet-end to (ii) the weight ratio of the alkenylsuccinic anhydride component in the sizing composition, is preferably less than about 1:1, or preferably less than about 0.5:1.

Applicants do not understand why, despite subjecting the sizing composition of this invention to conditions which cause rapid hydrolysis of alkenylsuccinic anhydride, the sizing composition imparts useful sizing properties to fibrous substrates. Without being bound by theory, it is believed that the relatively high ratio of starch to alkenylsuccinic anhydride component in the sizing composition imparts useful emulsifying and stabilizing properties.

The invention reduces or eliminates the amount of sizing agent used at the wet end, and thereby reduces or eliminates wet end interaction with other chemical additives and furnish components that are known to cause paper machine cleanliness problems. In one embodiment, the alkenylsuccinic anhydride in the wet end sizing agent component is 50% or less of the total alkenylsuccinic anhydride used during an operating period. In another embodiment, the alkenylsuccinic anhydride in the wet end is present in an amount that is 40% or less, or 30% or less than 20% or less than 10% of the total cellulose-reactve sizing agents used during an operating period.

The alkenylsuccinic anhydride component (or alkyl ketene dimer component) component contained in the sizing composition, when applied to a surface of a fibrous substrate, is retained in the fibrous substrate at higher levels as compared to when alkenylsuccinic anhydride is added to a pulp slurry.

The invention also enables its user to produce the same amount of paper that would ordinarily be produced by known processes by using less sizing agent. In one embodiment, the invention uses less than 50 percent or from about 70 to about 30 percent less sizing agent that is used in an ordinary process and still produces the same amount of paper without the problems ordinarily encountered with known sizing processes. The invention also provides a system that enables its user to use less amounts of alkenylsuccinic anhydride without sacrificing the quality or amount of paper that is produced at a mill.

Since problems ordinarily encountered with conventional sizing processes are avoided and a higher retention of size is obtained by directly treating a fibrous substrate, it is now possible for papermakers to produce more paper with less sizing agent than they have been accustomed to using. The invention allows papermakers to run papermaking machines for prolonged period of times without problems typically encountered with ordinary sizing compositions, e.g., problems with runnability, deposit formation, or inconsistent quality of paper products. The invention, for instance, allows paper machines to be run for long periods of time without visible deposition to the size press or calendar stack.

The invention is primarily directed to embodiments in which the sizing composition of the invention is made with an emulsion containing an alkenylsuccinic anhydride component. The invention, however, also includes embodiments in which the emulsion is made with cellulose-reactive agents other than alkenylsuccinic anhydride. For instance, in one embodiment, the sizing composition can be made with an emulsion containing emulsified cellulose-reactive agents selected from the group consisting of isocyanates and acid anhydrides, and alkyl ketene dimer(AKD).

As such, in one embodiment, the invention can be made or practiced with AKD instead of ASA. As used herein, the term "AKD" refers to alkyl and alkenyl ketene formed into dimers with a chemical structure accepted by those of ordinary skill in the art where AKD contains a hydrophobic group containing more than about 4 carbon atoms and selected from alkyl, alkenyl, aralkyl or aralkenyl groups, as defined above. Preferably, each hydrocarbon group is, independently, a hydrophobic group containing from about 4 carbon atoms to about 36 carbon atoms. AKD sizing agents are described in detail in several references, for example, U.S. Pat. Nos. 3,992,345 and 5,510,003; in J. W. Davis et al., TAPPI 39 (1), 21 (1956); and in R. E. Cates et al., "Alkyl Ketene Dimer Sizes", Chapter 2 in The Sizing of Paper, 2nd Edition, W. F. Reynolds, Ed., Tappi Press, 1989, pp. 33-50. Specific examples of AKD sizing agents useful in the instant invention include but are not limited to octyl ketene dimer, decyl ketene dimer, dodecyl ketene dimer, tetradecyl ketene dimer, hexadecyl ketene dimer, octadecyl ketene dimer, eicosyl ketene dimer, docosyl ketene dimer, tetracosyl ketene dimer, and those prepared by known methods from organic acids and naturally occurring mixtures of fatty acids such as those found in palmitoleic acid, oleic acid, rincinoleic acid, linoleic acid, linolenic acid, coconut oil, palm oil, olive oil and peanut oil. Mixtures of any of such acids may also be used. Preferred AKD sizing agents include but are not limited to those comprising at least one alkyl or alkenyl group comprising from about 8 to about 36 carbon atoms. More preferred AKD sizing agents include but are not limited to hexadecyl, octadecyl and oleyl ketene dimer. It is understood that the embodiments in which AKD is used instead of ASA, the description of the sizing compositions containing ASA described above (and methods of making and using the compositions) can also be used for sizing compositions in which AKD is used. Accordingly, when the term "alkenylsuccinic anhydride" or "ASA" is used above to describe the invention, the term "AKD" can be also be used instead of the term "alkenylsuccinic anhydride" or "ASA." In one embodiment, the AKD excludes 2 oxetanone ketene multimer.

The invention is further described in the following illustrative Examples in which all parts and percentages are by weight unless otherwise indicated.

EXAMPLES

Example 1

Example 1 is an overview of an application of alkenylsuccinic anhydride at the size press in a recycled board mill. No deposits or runnability issues due to hydrolysis of alkenylsuccinic anhydride in hot starch dispersion were encountered.

Procedure

Alkenylsuccinic anhydride was emulsified in nonionic oxidized starch (a blend of waxy maize and dent corn), using a high shear turbine pump. The alkenylsuccinic anhydride flow rate was about 114 lb/hr. The flow rate of 1.5 gpm of the oxidized starch was used for emulsification and an additional flow of 3 gpm of the starch was used for immediate dilution of the emulsion. The starch solids ranged from 7-10%. No pH adjustment or temperature cooling was done before emulsification. The pH of the starch was about 7 and the temperature in the pump ranged from 140 to 160° F. (60 to 71° C.).

The sizing composition, formed once the emulsion was added to the size press starch, contained about 0.12% alkenylsuccinic anhydride, at a starch:alkenylsuccinic anhydride component ratio ranging from 60:1 to 90:1. The composition of the recycled furnish was a mix of mixed office waste and old corrugated container board. During application of size press alkenylsuccinic anhydride, no internal size was added. Internal starch and alum were completely eliminated as well.

Table 1 below shows the reduction in size dosage with size press application of alkenylsuccinic anhydride in a board mill. Sizing is measure by the Cobb test. (TAPPI) test method T441. Cobb is a measure of the amount of water pick-up in a designated amount of time by the paper substrate. It is obtained by subtracting the dry weight of a sample from the wet weight of a sample. Thus a lower Cobb value translates to higher sizing.

TABLE 1

| Sizing Additive | Application | Average Sizing 30-minute Cobb ($g/m^2$ top/ $g/m^2$ bottom) | Avg. Dose | Dose Reduction |
|---|---|---|---|---|
| Internal alkenylsuccinic anhydride | Emulsified in cationic wet-end starch; Alum added as a promoter. | 120 ± 20 | 4.3 lb/ton | N/A |
| Surface alkenylsuccinic anhydride | Emulsified in non ionic size press starch at 0.5/1 starch:size ratio; sizing composition starch:size ratio - 80:1 | 120 ± 20 | 2.5 lb/ton | 42% |

Example 2

Example 2 illustrates the use of the invention in a fine paper application. The application of the same dosage of alkenylsuccinic anhydride at the size press provided a much lower Cobb value. The example illustrates how a size press applied alkenylsuccinic anhydride provides a clear economic advantage for the papermaker by lowering chemical costs.

The example is an illustration of the application of alkenylsuccinic anhydride at the size press on a pilot plant machine. Because of the required lower chemical dosages for this pilot plant operation, the preparation of the alkenylsuccinic anhydride emulsion was completed in a batch form.

Procedure

The alkenylsuccinic anhydride was emulsified in hydroxyethylated dent corn starch, where the starch solids were 7%. The starch pH was about 7, and the starch temperature of about 30-35° C. For emulsification, a high shear industrial blender was used. The preparation of the emulsion was done by taking 1429 grams of starch solution and 100 grams of alkenylsuccinic anhydride for a 1:1 starch to alkenylsuccinic anhydride component ratio providing a final concentration of 6.5% alkenylsuccinic anhydride in starch solution. The emulsion was prepared by emulsifying at high shear for 30 seconds. The emulsion was added to the size press starch. Enough sizing emulsion was added to obtain a pickup of 2.25 lb/ton of active size. Based on starch pick-up and dosage requirement, the final alkenylsuccinic anhydride concentration in the sizing composition was about 0.15% for a starch: size ratio of about 60:1.

Table 2 describes the papermaking conditions and Table 2a shows the reduction in size dosage with size press application of alkenylsuccinic anhydride, in accordance to the invention, in fine paper application.

TABLE 2

| | |
|---|---|
| Machine Type: | Fourdrinier Pilot Machine |
| Machine Production/Speed: | 60-85 lb/hr; 85 ft/min. |
| Paper Grade: | 70 $g/m^2$ writing paper |
| Furnish Type: | Bleached Kraft w/20% PCC Filler Loading |
| Size Press Type: | Flooded Nip |
| Starch Pick-up at Size Press: | 126 lb/ton |

TABLE 2a

| Sizing Additive | Application | 2-Minute Cobb ($g/m^2$) | Avg. Dose | Percent Improvement in sizing |
|---|---|---|---|---|
| Internal alkenylsuccinic anhydride | Emulsified in cationic Starch at 1:1 starch to Alkenylsuccinic anhydride component ratio; final starch:size ratio 4:1 | 114 | 2.25 lb/ton | NA |
| Surface alkenylsuccinic anhydride | Emulsified in hydroxyethylated Starch at 1:1 starch to alkenylsuccinic anhydride component ratio; final solution starch:size ratio ~60:1 | 33 | 2.25 lb/ton | 71% |

Examples 3-72

Procedures, Tests, Materials

Paper Preparation Procedures

The papers used in these examples were prepared from two sources. One set was a pilot paper machine. The furnish was 30% bleached softwood kraft refined to 420 Canadian Standard Freeness and 70% bleached hardwood kraft refined to 350 Canadian Standard Freeness. Four papers were prepared using an anionic, polyacrylamide retention aid. Paper A was a 70 $g/m^2$ sheet containing 14.9% calcium carbonate (ALBACART™ 5970, Specialty Minerals Inc.,) and no internal sizing. Paper B was a 70 $g/m^2$ sheet containing 14.9% calcium carbonate and a pre-determined amount of added internal size, ASA, (BAYSIZE® I 18 synthetic size). Paper C was a 125 $g/m^2$ sheet containing 25% calcium carbonate (ALBACAR 5970) with no internal sizing. Paper D was a 125 $g/m^2$ sheet containing 25% calcium carbonate (ALBACAR 5970) and a pre-determined amount of added internal size (BAYSIZE I 18 synthetic size). Water emulsions prepared for use in internal addition were made with cationic starch (Penford Hi-Cat CWS starch), ASA internal size at a weight ratio of 1:1 (starch:size) using a Ross Homogenizer The second set of papers was prepared on a commercial paper machine from mixed office waste. The basis weight of this paper was 126 $g/m^2$ and contains 7 weight percent calcium carbonate (ALBACAR 5970) and no internal size. This paper was designated as Paper E.

Starch Solutions

A starch solution was prepared by making a 15% starch solids slurry of a commercially available surface size starch (Filmflex® 60 starch, Cargill) in deionized water that has been adjusted to pH 7.0+/−0.2 with either 0.5N HCl or 0.5N NaOH, (hereby referred to as Treated Water A) and heating the mixture to 95° C. for 1 hour. This was called Starch Solution A.

To 150 parts of Starch Solution A were added 600 parts of Treated Water A. Then, 0.5N NaOH solution was added dropwise to provide a starch solution of pH 7.1-7.3. This is a 3% starch solution called Starch Solution B.

To 150 parts of Starch Solution A were added 171.4 parts of Treated Water A. Then, 0.5N NaOH solution was added dropwise to provide a starch solution of pH 7.1-7.3. This is a 7% starch solution called Starch Solution C.

Surface Application Procedure A

The appropriate sizing composition was then used to treat paper samples. The desired dosage was calculated based upon the liquid pick-up of the composition on the dry paper sheet. This was determined by measuring the weight difference between the dry sheet and the sheet that has been dipped into the surface treatment solution (and pressed). The various Papers A, B, C, D, or E were cut to a suitable size, weighed, dipped into the various sizing compositions, pressed at a pressure of 12 psig, and then dried at 240° F. for 35 seconds. The dose levels were reported in lb/ton, i.e., pounds of dry sizing agent per ton of dry paper.

Treatment Effectiveness Tests

The treatment effectiveness of the sizing agents and conditions was determined by performing some of the various test described below. The general procedures for these tests were provided below.

Test A Ink Penetration Holdout

Ink Penetration Holdout was measured using a method similar to that described in TAPPI Method T 530 pm-89 except that an instrument was used as described in U.S. Pat. No. 5,483,078. The test measures the time (in seconds) for the reflectance of the paper on the side opposite that contacting the ink to decreases to 80% of the initial value. The ink consists of 1.25% Naphthol Green B dye buffered to pH 7. The test values were normalized for basis weight of the paper assuming that the values vary as the cube of the basis weight. Results were expressed in units of seconds.

Image Analysis

Image analysis was performed using an Optomax Sorcerer image analysis system equipped with morphometry application software, a stereo zoom microscope with CCD camera and ring fiber optic illumination. Several types of tests were used.

Test B Black Image Analysis

A commercially available ink jet printer was used to print onto a test sheet several rows of the letter "H" which was a bold, 8 point, Arial font. The areas of the four letters were then measured and averaged to provide the "black letter area". A smaller letter area corresponds to less spreading or wicking of the inked area. Results were expressed in units of $mm^2$.

Test C Color Bleed

Color bleed was determined by measuring the areas of black letters printed on a yellow background, in a similar fashion as described in the Black Image Analysis; a color inkjet printer must be used. Images of four letters were averaged to provide the "letter area". A smaller letter area corresponds to less spreading or wicking of the inked area. Results were expressed in units of $mm^2$.

Test D Optical Density

Solid, black areas of at least 1-$cm^2$ were printed onto the sheet to be tested. The optical density (OD) of the printed areas was measured with a commercially available X-Rite Spectrodensitometer. Values were the average of five measurements. The values were dimensionless. A higher optical density value was generally indicative of improved printability.

Test E Particle Size

Commercially available, light-scattering, particle analyzers, Horiba LA-300 and Horiba LA-700, were used to determine the particle size of the emulsions. Results were reported as the median particle size in μm.

Examples 3 through 7 show the effect of various starch to ASA weight ratios.

Example 3

To a household blender was added 120 parts of Starch Solution A. Added to this solution was 1.25 parts of Treated Water A. The speed on the blender was set to low. Alkenylsuccinic anhydride (ASA; BAYSIZE® S 180 synthetic size), 2.25 parts, was added into the vortex in one portion. After the addition, the speed was changed to high and held for 3 minutes.

Example 4

The procedure of Example 3 was repeated except that 121.4 parts of Starch Solution A and 3.6 parts of ASA were used.

Example 5

The procedure of Example 3 was repeated except that 41.7 parts of Starch Solution A, 6.3 parts of ASA, and 77 parts of Treated Water A were used.

Example 6

The procedure of Example 3 was repeated except that 20.9 parts of Starch Solution A, 6.3 parts of ASA and 97.8 parts of Treated Water A were used.

Example 7

The procedure of Example 3 was repeated except that 8.3 parts of Starch Solution A, 6.3 parts of ASA and 110.4 parts of Treated Water A were used.

Example 8

Sizing emulsions prepared in Examples 3 through 7 were used to treat Paper A. Each of the emulsions were added to additional Starch Solution A, the second starch component to make a total sizing composition for paper treatment. Surface Application Procedure A was used to test these examples on Paper C. The effectiveness of sizing was determined by printing the treated sheets on a commercial printer (HP Deskjet 648C) and measuring performance with the tests for Black Image Area and Color Bleed at 2 and 3 lb/ton, conducted as described in the test procedures above. The results were provided below in Table 3.

TABLE 3

| Emulsion Example | Starch:Size Ratio | Size Dose (lb/ton) | Particle Size (μm) | Black Image Area ($mm^2$) | Color Bleed ($mm^2$) |
|---|---|---|---|---|---|
| starch | 1:0 | — | — | 2.352 | 2.31 |
| 3 | 5:1 | 2 | 0.48 | 1.927 | 1.93 |
| 4 | 8:1 | 2 | 0.48 | 1.908 | 1.975 |

TABLE 3-continued

| Emulsion Example | Starch:Size Ratio | Size Dose (lb/ton) | Particle Size (μm) | Black Image Area ($mm^2$) | Color Bleed ($mm^2$) |
|---|---|---|---|---|---|
| 5 | 1:1 | 2 | 0.56 | 1.927 | 1.934 |
| 6 | 0.5:1 | 2 | 0.66 | 1.925 | 1.985 |
| 6 | 0.5:1 | 3 | 0.66 | 1.913 | 1.941 |
| 7 | 0.2:1 | 2 | 0.63 | 1.914 | 1.958 |
| 7 | 0.2:1 | 3 | 0.63 | 1.899 | 1.954 |
| base sheet | — | — | — | 2.446 | 2.326 |

These examples show that over a wide range of starch to ASA weight ratios, effective sizing properties were achieved as measured by printing properties.

Example 9 illustrates the effectiveness of this invention when large particle size is employed.

Example 9

A sizing system of the instant invention was used to provide surface treatment size to a commercial machine that produces linerboard, as described in Examples 1 and 2, except that the furnish was predominantly mixed office waste. The emulsion was prepared by passing the size press starch solution (7% solids; ethylated corn starch) through a commercial emulsifier into which ASA (BAYSIZE® S 180) size was fed. The emulsion was directly added to the size press (flooded-nip) feed line. A sample of the emulsion was withdrawn to determine that the median particle size was 8.28 μm according to test E. Thirty-minute Cobb values of 142 g were achieved, well within acceptable specification range of 120-150 $g/m^2$.

This example shows that particle sizes above 1 micron demonstrate effective sizing properties.

Examples 10-16 show the influence of hydrolyzed ASA on sizing performance as evidenced by printing properties.

Example 10

To a household blender was added 41.7 parts of Starch Solution A and 77 parts of Treated Water A. The speed on the blender was set to low. In one portion, 6.3 parts of alkenylsuccinic anhydride, (ASA, BAYSIZE® S 180 Synthetic Size) was added into the vortex. After the addition, the speed was changed to high and held for 3 minutes.

Sample A

Hydrolyzed ASA was prepared by taking equimolar amount of ASA and water and stirring the mixture over several days at 50° C. Infrared analysis indicated complete hydrolysis with no anhydride peaks present. This material was labeled as Sample A.

Example 11

To a household blender was added 41.7 parts of Starch Solution A, 77 part of Treated Water A. The speed on the blender was set to low. In one portion, 5.6 parts of alkenylsuccinic anhydride and 0.6 parts of Sample A was added to this solution. The speed of the blender was changed to high and maintained at that stirring rate for three minutes.

Example 12

The procedure of Example 11 was repeated except that the 4.7 parts of ASA and 1.6 parts of Sample A was used.

Example 13

The procedure of Example 11 was repeated except that the 3.1 parts of ASA and 3.1 parts of Sample A was used.

Example 14

The procedure of Example 11 was repeated except that the 0.9 parts of ASA and 5.4 parts of Sample A was used.

Example 15

The procedure of Example 11 was repeated except that the 0.6 parts of ASA and 5.6 parts of Sample A was used.

Example 16

Sizing emulsions prepared in Examples 10 through 15 were used to size paper by the Surface Application Procedure A. Each of the emulsions were separately added to additional Starch Solution A, the second starch component, to make a total sizing composition for paper treatment. Surface Application Procedure A was used to treat the Paper C. The effectiveness of sizing was determined by printing the treated sheets on a commercial printer (HP Deskjet 648C) and measuring performance with the tests for Black Image Area and Color Bleed at 2 to 23 lb/ton, conducted as described in the test procedures above. The results were provided below in Table 4.

TABLE 4

| Emulsion Example | ASA:HASA Ratio | ASA Dose (lb/ton) | Particle Size (μm) | Black Image Area ($mm^2$) | Color Bleed ($mm^2$) |
|---|---|---|---|---|---|
| Control | base sheet | — | — | 2.446 | 2.326 |
| Control | Starch only | — | — | 2.352 | 2.310 |
| 10 | ASA only | 2 | 0.83 | 1.951 | 2.036 |
| 10 | ASA only | 2.25 | 0.83 | 1.961 | 2.036 |
| 11 | 9:1 | 2 | 0.57 | 1.964 | 2.020 |
| 11 | 9:1 | 2.25 | 0.57 | 1.959 | 2.028 |
| 11 | 9:1 | 2.5 | 0.57 | 1.968 | 2.072 |
| 12 | 3:1 | 2.25 | 0.4 | 2.000 | 2.057 |
| 12 | 3:1 | 2.7 | 0.4 | 1.946 | 2.045 |
| 12 | 3:1 | 3 | 0.4 | 1.991 | 2.042 |
| 13 | 1:1 | 4 | 0.54 | 1.960 | 2.064 |
| 13 | 1:1 | 4.5 | 0.54 | 1.958 | 2.040 |
| 14 | 1:6 | 14 | 1.33 | 2.045 | 2.052 |
| 14 | 1:6 | 15.75 | 1.33 | 2.008 | 2.059 |
| 15 | 1:9 | 20 | 1.4 | 2.035 | 2.084 |
| 15 | 1:9 | 23 | 1.4 | 2.054 | 2.080 |

These examples show that over a wide range of alkenylsuccinic anhydride/hydrolyzed alkenylsuccinic anhydride (ASA/HASA) ratio, a small particle size and effective printing properties were achieved.

Examples 17-20

These Examples show that over a wide range of ASA/HASA ratios, a small particle size and effective printing properties are achieved.

In these examples, in situ-generated hydrolyzed ASA was used. The emulsion was prepared according to Example 3 except that 106.7 parts of Starch Solution A, 277.3 parts of Treated Water A, and 16 parts of ASA were used to give a 4% ASA solution with a 1:1 starch:size ratio. The emulsion was placed in a vessel equipped with an overhead stirrer. The vessel was heated in a water bath maintained at 50° C. This was Reaction A. Periodically, aliquots of Reaction A were withdrawn and analyzed for anhydride content and surface sizing efficiency. The amount of anhydride in the initial emulsion was measure using a morpholine titration (ref.: R. B. Wasser, "The Reactivity of Alkenylsuccinic Anhydride: It's Pertinence to Alkaline Sizing," 1985 Alkaline Papermaking Conference, page 17, TAPPI Press). Surface sizing experiments were conducted according to Surface Treatment Procedure A. The solids content of the Reaction A aliquot was added to Starch Solution B such that the dose of the size on the treated sheet was 0.5 pounds of size per ton of dry paper. Paper B was treated for the examples.

Every 1.5 hours for 4.5 hours, an aliquot of the initial emulsion that was stirring at 50° C. was removed and tested for % anhydride and particle size. Sheets were treated as described with the aging emulsion. The resulting sheets were tested for sizing using Test A. Twelve sizing measurements were made on each sheet and averaged. The results are shown in Table 5.

TABLE 5

| Example No. | Elapsed Time (hours) | ASA Dose | % Hydrolyzed ASA, as % of Total | Particle Size (μm) | Ink Penetration |
|---|---|---|---|---|---|
| | base sheet | 0 | | | 54 |
| | base sheet + starch | 0 | | | 74 |
| 17 | 0 | 0.5 | 5.1 | 0.667 | 492 |
| 18 | 1.5 | 0.5 | 19.5 | 0.726 | 536 |
| 19 | 3.0 | 0.5 | 70.3 | 0.773 | 364 |
| 20 | 4.5 | 0.5 | 94.9 | 0.803 | 222 |

These examples illustrate that an effective amount of ink penetration hold-out was exhibited in paper treated with sizing emulsion containing hydrolyzed ASA. Surprisingly, there was no separation or deposition of the ASA or hydrolyzed ASA in the starch/ASA emulsion. This solution remained stable for several days.

Examples 21-30

The following examples demonstrate the utility of the instant invention using two different surfactants over a range of surfactant levels in the sizing agent. Surfactant A was AEROSOL® OTS surfactant (Cytec Industries, Inc.). Surfactant B was Rhodafac®RS610 surfactant (Rhodia).

Example 21

In a blender was charged 142 parts of Starch Solution C. The blender was turned on a low speed and into the vortex was added in 9.99 parts of ASA and 0.01 part of Surfactant A. The blender was placed on the high speed setting and run for one minute.

Example 22

An emulsion was prepared in a similar manner as in Example 21, except that 9.9 parts of ASA and 0.1 part of Surfactant A were used.

Example 23

An emulsion was prepared in a similar manner as in Example 21, except that 9.5 parts of ASA and 0.5 part of Surfactant A were used.

Example 24

An emulsion was prepared in a similar manner as in Example 21, except that 9.0 parts of ASA and 1.0 part of Surfactant A were used.

Example 25

An emulsion was prepared in a similar manner as in Example 21, except that 9.99 parts of ASA and 0.01 part of Surfactant B were used.

Example 26

An emulsion was prepared in a similar manner as in Example 21, except that 9.9 parts of ASA and 0.1 part of Surfactant B were used.

Example 27

An emulsion was prepared in a similar manner as in Example 21, except that 9.5 parts of ASA and 0.5 part of Surfactant B were used.

Example 28

An emulsion was prepared in a similar manner as in Example 21, except that 9.0 parts of ASA and 1.0 part of Surfactant B were used.

Example 29

Sizing emulsion prepared in Examples 21-28 were used to size paper by the Surface Application A. Each of the emulsions were separately added to additional Starch Solution B, the second starch component, to make a total sizing composition for paper treatment. Surface Application A was used to treat Paper A. The effectiveness of the sizing was determined by Test A Ink Penetration Holdout described above. Emulsion particle size for each of the emulsions was measured using the Test E Particle Size described above. The results were provided below in Table 6.

TABLE 6

| Emulsion Example | Surfactant | Surfactant Level (%) | ASA Dose (lb/ton) | Ink Penetration (sec) |
|---|---|---|---|---|
| Control | Unsized basesheet plus starch | 0 | 0 | 0 |
| 21 | AEROSOL ® OTS | 0.1 | 3 | 740 |
| 25 | Rhodofac ® RS610 | 0.1 | 3 | 593 |
| 22 | AEROSOL ® OTS | 1 | 3 | 693 |
| 26 | Rhodofac ® RS610 | 1 | 3 | 573 |
| 23 | AEROSOL ® OTS | 5 | 3 | 434 |
| 27 | Rhodofac ® RS610 | 5 | 3 | 388 |
| 24 | AEROSOL ® OTS | 10 | 3 | 365 |
| 28 | Rhodofac ® RS610 | 10 | 3 | 447 |

Example 30

Sizing emulsion prepared in Examples 21-28 were used to size paper by the Surface application A. Each of the emulsions were separately added to additional Starch Solution B, the second starch component, to make a total sizing composition for paper treatment. Surface Application A was used to treat Paper B. The effectiveness of the sizing was determined by Test A Ink Penetration Holdout described above. Emulsion particle size for each of the emulsions was measured using the Test E Particle size described above. The results were provided below in Table 7.

TABLE 7

| Emulsion Example | Surfactant | Surfactant Level (%) | ASA Dose (lb/ton) | Ink Penetration (sec) |
|---|---|---|---|---|
| Control | Sized basesheet plus starch | 0 | 0 | 3 |
| 21 | AEROSOL ® OTS | 0.1 | 1 | 637 |
| 25 | Rhodofac ® RS610 | 0.1 | 1 | 685 |
| 22 | AEROSOL ® OTS | 1 | 1 | 793 |
| 26 | Rhodofac ® RS610 | 1 | 1 | 637 |
| 23 | AEROSOL ® OTS | 5 | 1 | 698 |
| 27 | Rhodofac ® RS610 | 5 | 1 | 588 |
| 24 | AEROSOL ® OTS | 10 | 1 | 745 |
| 28 | Rhodofac ® RS610 | 10 | 1 | 744 |

The data of these examples illustrate the fact that even though the sizing solution contains a varying amount of surfactant, an effective amount of ink penetration holdout was observed in the sheet.

Examples 31-39

These Examples illustrate the effect of starch dilution on emulsion stability for a variety of starches.

Starch Preparation Procedure A

In a jacketed reactor heated by steam 141 parts of as-is dry starch and 859 parts of Treated Water A were slurried. The vessel was heated with steam until the liquid achieved a temperature between 95° C.-100° C. and was then held at that temperature for 1 hour. The starch solid was equal to 12-wt percent. The solution pH was adjusted to 7.2+/−0.1 with 0.5N NaOH, and used as illustrated in the examples below.

Example 31

A solution of anionic, oxidized dent corn starch (Clearsol® 10 Gum; Penford Products Co.) was prepared according to the Starch Preparation Procedure A. This starch solution was used for the preparation of the ASA emulsion and for the dilution of the ASA emulsion as it is described below.

In a household blender 60.0 parts of the starch solution and 52.8 parts of Treated Water A were added. The blender was turned on low speed, and into the vortex was introduced 7.2 parts of ASA (BAYSIZE® S 180 synthetic size). Upon completion of addition, the speed was changed to high for three minutes. The weight ratio of starch to ASA in this emulsion is 1:1. This was ASA Emulsion A.

A total of 16.67 parts of ASA Emulsion A was diluted with 158.41 parts of the starch solution and 24.92 parts of Treated Water A to provide a final concentration of 0.5 wt % ASA. The final weight ratio of starch to ASA was 20:1.

Comparative Example 32

The procedure of Example 31 was repeated, except that 16.67 parts of Emulsion A was diluted with 183.33 parts of Treated Water A to provide a final concentration of 0.5 wt % ASA. The weight ratio of starch to ASA was 1:1.

Example 33

A solution of oxidized, dent corn starch was prepared according to the Starch Preparation Procedure A. This starch-solution was used for the preparation of the ASA emulsion and for the dilution of the ASA emulsion as it is described below.

In a household blender 60.0 parts of the starch solution and 52.8 parts of Treated Water A were added. The blender was turned on low speed, and into the vortex was introduced 7.2 parts of ASA (BAYSIZE S 180 synthetic size). Upon completion of addition, the speed was changed to high for three minutes. The weight ratio of starch to ASA in this emulsion is 1:1. This was ASA Emulsion B.

A total of 4.0 parts of ASA Emulsion B was diluted with 48.06 parts of the starch solution and 147.94 parts of Treated Water A to provide a final concentration of 0.12 wt % ASA. The final weight ratio of starch to ASA was 25:1.

Comparative Example 34

The procedure of Example 33 was repeated, except that 4 parts of Emulsion B was diluted with 196.0 parts of Treated Water A to yield an ASA concentration of 0.12 weight percent with a starch to ASA ratio of 1:1.

Example 35

A solution of cationic, acid-thinned waxy maize starch (Charge®+34; Cargill, Inc.) was prepared according to the Starch Preparation Procedure A. This starch solution was used for the preparation of the ASA emulsion and for the dilution of the ASA emulsion as it is described below.

In a household blender 60.0 parts of the starch solution and 52.8 parts of Treated Water A were added. The blender was turned on low speed, and into the vortex was introduced 7.2 parts of ASA (BAYSIZE S 180 synthetic size). Upon completion of addition, the speed was changed to high for three minutes. The weight ratio of starch to ASA in this emulsion is 1:1. This was ASA Emulsion C.

A total of 16.67 parts of Emulsion C was diluted with 158.41 parts of the starch solution and. 24.92 parts of treated Water A. The concentration of ASA in this example was 0.5 weight percent and the ratio of starch to ASA was 20:1.

Comparative Example 36

The procedure of Example 35 was repeated, except that 16.67 parts of Emulsion C were diluted with 183.33 parts of Treated Water A.

The concentration of ASA in this example was 0.5 weight percent and the ratio of starch to ASA was 1:1.

Example 37

The procedure of Example 35 was repeated, except that 4 parts of Emulsion C were diluted with 48.06 parts the starch solution and 147.94 parts of Treated Water A. The concentration of ASA in this example was 0.12 weight percent and the starch to ASA ratio was 25:1.

Comparative Example 38

The procedure of Example 35 was repeated, except that 4 parts of Emulsion C were diluted with 196.0 parts of Treated Water A. The concentration of ASA in this example was 0.12 weight percent and the starch to ASA ratio was 1:1.

Example 39

The diluted ASA emulsions from Example 31, 32, 33, 34, 35, 36, 37, and 38 were separately placed in a 70° C. water bath and mixed with an overhead stirrer for one hour. After 1 hr, the mixing was stopped, and the diluted emulsions were stored at room temperature for 7 days. The observations regarding emulsions quality were made. These observations indicated that at the high starch to ASA ratio of 25/1 and 20/1, the ASA emulsions were well dispersed in the solution. At the low starch to ASA ratio of 1/1, the ASA emulsions separated from the solution, creating a white layer on the top or bottom of the container. The results were presented in Table 8.

TABLE 8

| Example | Type of Starch | Starch: ASA Ratio | ASA Concentration (%) | Observation After 7 days |
|---|---|---|---|---|
| 31 | Anionic Dent Corn Starch Clearsol 10 Gum | 20:1 | 0.5 | No emulsion separation |
| Comparative 32 | Anionic Dent Corn Starch Clearsol 10 Gum | 1:1 | 0.5 | Emulsion was separated |
| 33 | Anionic Dent Corn Starch | 25:1 | 0.12 | No emulsion separation |
| Comparative 34 | Anionic Dent Corn Starch | 1:1 | 0.12 | Emulsion was separated |
| 35 | Cationic Waxy Maize Starch Charge + 34 | 20:1 | 0.5 | No emulsion separation |
| Comparative 36 | Cationic Waxy Maize Starch Charge + 34 | 1:1 | 0.5 | Emulsion was separated |
| 37 | Cationic Waxy Maize Starch Charge + 34 | 25:1 | 0.12 | No emulsion separation |
| Comparative 38 | Cationic Waxy Maize Starch Charge + 34 | 1:1 | 0.12 | Emulsion was separated |

These examples show that the higher starch to size ratios promote emulsion stability with a number of different starches.

Examples 40-44

These Examples show the positive impact of higher starch ratios on application performance Surface Application Procedure B A Werner Mathis laboratory size press was adapted for use in flooded-nip, paper size press applications. The laboratory flooded-nip size press consists of two, hard rubber rollers. The nip pressure between these two rollers was adjustable. The speed of rollers was varied to maximize pick-up. Pick-up of the size press solutions was determined by weighing test sheets before and after passing through the nip contain the targeted size press liquid. The test liquids were then dosed with the appropriate amount of treatment solution (real solids based upon dry starch pick-up). Test solutions were added to the nip and the paper sample was fed through the nip. The dose was expressed as pounds of real substrate per ton of dry paper. The treated paper sample was immediately passed through a rotary drum dryer heated at 240° F. for 35 sec. The samples were then conditioned at 50% relative humidity and 70° C. for 24 hours before testing.

Example 40

A starch solution was prepared according to Starch Preparation Procedure A included in the set of SAMPLES 31 to 39, except that an ethylated, dent corn starch (Filmflex® 60 starch, Cargill) was used. The starch concentration of this solution was 12 weight percent. This starch solution was used to make the ASA emulsion and to prepare the size press solution.

In a household blender 40.06 parts of the starch solution and 75.14 parts of Treated Water A were added. The blender was turned on low speed, and into the vortex was introduced 4.8 parts of ASA (BAYSIZE S 180 synthetic size). Upon completion of addition, the speed was changed to high for three minutes. The concentration of ASA in this emulsion was 4.0 weight percent and the weight ratio of starch to ASA was 1:1. This was ASA Emulsion A.

A size press solution was prepared by adding 4.33 parts of Emulsion A to 37.53 parts of the starch solution and 112.47 parts of Treated Water A. The weight ratio of starch to ASA in the size press solution was 27:1. The size press solution was used to surface treat three sheets of Paper A (70 g/m$^2$ sheets containing 14.9% calcium carbonate and no internal sizing) according to the Surface Application Procedure B. In this manner, a dose of 2 dry pounds of size was added per ton of dry paper fiber.

Example 41

The procedure of Example 40 was repeated, except that the size press solution was prepared by adding 4.53 parts of Emulsion A to 25.02 parts of the starch solution and 124.98 parts of Treated Water A. The weight ratio of starch to ASA in the size press solution of this example was 18:1.

Example 42 (Comparative)

The procedure of Example 40 was repeated, except that the size press solution was prepared by adding 4.65 parts of Emulsion A to 12.51 parts of the starch solution and 137.49 parts of Treated water A. The weight ratio of starch to ASA in the size press solution of this example was 9:1.

Example 43 (Comparative)

The procedure of Example 40 was repeated, except that the size press solution was prepared by adding 4.78 parts of Emulsion A to 6.25 parts of the starch solution and 143.75 parts of Treated Water A. The weight ratio of starch to ASA in the size press solution of this example was 5:1.

Example 44 (Comparative)

The procedure of Example 40 was repeated, except that the size press solution was prepared by adding 4.84 parts of Emulsion A to 150 parts of Treated Water A. The weight ratio of starch to ASA in the size press solution of this example was 1:1.

Summary of Examples 40-44

The effectiveness of Sizing Emulsions described in Examples 40, 41, 42, 43 and 44 was determined by black letter area and letter area color bleed tests performed on paper sized with these sizing compositions. These tests are described above. The results in Table 9 show that the sizing compositions of the invention, Example 40 (27/1 starch/ASA ratio) and example 41 (18/1 starch/ASA ratio), provided improved black letter area and color bleed letter area than comparative sizing compositions from examples 42, 43, and 44. These comparative examples have a starch/ASA ratio of 9/1, 5/1 and 1/1, respectively.

TABLE 9

| Example # | Starch/ASA Ratio | Black Image Area (mm$^2$) | Color Bleed (mm$^2$) |
|---|---|---|---|
| 40 | 27/1 | 2.051 | 2.267 |
| 41 | 18/1 | 2.060 | 2.321 |
| 42 comparative | 9/1 | 2.151 | 2.444 |
| 43 comparative | 5/1 | 2.218 | 2.450 |
| 44 comparative | 1/1 | 2.225 | 2.469 |

Examples 45-48

These examples show that there was a trend of increased black image area and color bleed with a decrease in the starch:ASA ratio, indicating poorer sizing efficiency.

Example 45

A starch solution was prepared according to Starch Preparation Procedure A included in the set of SAMPLES 31 to 39, except that an ethylated, dent corn starch (Filmflex® 60 starch, Cargill) was used. The starch concentration of this solution was 12 weight percent. This starch solution was used to make the ASA emulsion and to prepare the size press solution.

In a household blender 40.06 parts of the starch solution and 75.14 parts of Treated Water A were added. The blender was turned on low speed, and into the vortex was introduced 4.8 parts of ASA (BAYSIZE S 180 synthetic size). Upon completion of addition, the speed was changed to high for three minutes. The concentration of ASA in this emulsion was 4.0 weight percent and the weight ratio of starch to ASA was 1:1. This was ASA Emulsion A.

A size press solution was prepared by adding 4.38 parts of Emulsion A to 75.0 of the starch solution and 75.0 parts of Treated Water A. The weight ratio of starch to ASA in the size press solution was 52.4:1. The size press solution was used to surface treat three sheets of Paper E (126 g/m$^2$ sheets containing 7 wt % calcium carbonate and no internal size) according to the Surface Application Procedure B. In this manner, a dose of 1.75 dry pounds of size was added per ton of dry paper fiber.

Example 46

The procedure of Example 45 was repeated, except that the size press solution was prepared by adding 3.63 parts of Emulsion A to 37.53 parts of the starch solution and 112.47 parts of Treated Water A. The weight ratio of starch to ASA in the size press solution of this Example was 32:1.

Example 47

The procedure of Example 45 was repeated, except that the size press solution was prepared by adding 3.79 parts of Emulsion A to 12.51 parts of the starch solution and 137.49 parts of Treated Water A. The weight ratio of starch to ASA in the size press solution of this example was 10.9:1.

Example 48 (Comparative)

The procedure of Example 45 was repeated, except that the size press solution was prepared by adding 3.88 parts of Emulsion A to 6.25 parts of the starch solution and 143.75 parts of Treated Water A. The weight ratio of starch to ASA in the size press solution of this example was 5.8:1.

Summary of Examples 45-48

The effectiveness of sizing compositions described in Examples 45, 46, 47, and 48 was determined by analysis using the Black Optical Density Test. The results in Table 10 show that the sizing compositions of the invention, Example 45 (52.4/1 starch/ASA ratio), Example 46 (32/1 starch/ASA ratio) and Example 47 (10.9/1 starch/ASA ratio), provide better black optical density than the comparative sizing composition from Example 48 (5.8/1 starch/ASA ratio).

TABLE 10

| Example # | Starch:ASA Ratio | Optical Density |
|---|---|---|
| 45 | 52.4:1 | 1.460 |
| 46 | 32.0:1 | 1.440 |
| 47 | 10.9:1 | 1.426 |
| 48 | 5.8:1 | 1.408 |

These examples show that there was a clear trend of decreasing back optical density with the decrease of the starch/ASA ratio, indicative of poorer sizing.

Although the present invention has been described in detail with reference to certain preferred versions thereof, other variations are possible. Therefore, the spirit and scope of the appended claims should not be limited to the description of the versions contained therein.

What is claimed is:

1. A method for making a sizing composition comprising the sequential steps of:

(a) emulsifying components consisting of
alkenylsuccinic anhydride,
a first starch component, wherein the first starch component is an aqueous starch solution consisting of water and a starch selected from the group consisting of non-ionic starches, anionic starches, and mixtures thereof, and
optionally, a surfactant component consisting of a surfactant selected from the group consisting of anionic surfactants and nonionic surfactants to form an emulsion consisting of the alkenylsuccinic anhydride, the first starch component, and, optionally, the surfactant component; and (b) combining the emulsion with a second starch component selected from the group consisting of non-ionic starches, ionic starches, and mixtures thereof, and thereby forming a sizing composition;

wherein the alkenylsuccinic anhydride and the starch in the emulsion and the second starch component are present at a starch:alkenylsuccinic anhydride weight ratio that is sufficiently high to enable the sizing composition to impart useful sizing properties to a fibrous substrate when the sizing composition contacts the-fibrous substrate; and wherein the starch component of the starch: alkenylsuccinic anhydride weight ratio is the total weight of the first starch component and the second starch component.

2. The method of claim 1, wherein the first starch component contains starch consisting of the product of modifying a corn starch, potato starch, wheat starch, tapioca starch, or sorghum starch by oxidation.

3. The method of claim 1, wherein the first starch component contains starch consisting of the product of modifying a corn starch, potato starch, wheat starch, tapioca starch, or sorghum starch by acid modification.

4. The method of claim 1, wherein the first starch component contains starch consisting of the product of modifying a corn starch, potato starch, wheat starch, tapioca starch, or sorghum starch by heat treatment.

5. The method of claim 1, wherein the first starch component contains starch consisting of the product of modifying a corn starch, potato starch, wheat starch, tapioca starch, or sorghum starch by acetylation.

6. The method of claim 1, wherein the first starch component contains starch consisting of the product of modifying a corn starch, potato starch, wheat starch, tapioca starch, or sorghum starch by hydroxyethylation.

7. The method of claim 1, wherein the weight ratio of the first starch component starch to the alkenylsuccinic anhydride is about 0.2:1 to about 20:1.

8. The method of claim 1, wherein the weight ratio of the total weight of the first starch component starch and the second starch component starch to alkenylsuccinic anhydride is about 10:1 to about 200:1.

9. The method of claim 1, wherein the aqueous starch solution has a starch solids content of about 1 to about 20 weight percent, based on the total weight of the aqueous starch solution.

10. A process for making a sizing composition comprising the sequential steps of:

(a) emulsifying alkenylsuccinic anhydride with a first starch component containing starch selected from the group consisting of non-ionic starches, anionic starches, and mixtures thereof, and thereby forming an emulsion consisting of the alkenylsuccinic anhydride and the first starch component; wherein the first starch component contains starch consisting of the product of modifying a corn starch, potato starch, wheat starch, tapioca starch, or sorghum starch by a process selected from oxidation, acid modification, heat treatment, acetylation, and hydroxyethylation; and wherein the first starch component contains a nonionic oxidized starch; and (b) combining the emulsion with a second starch component selected from the group consisting of non-ionic starches, ionic starches, and mixtures thereof, and thereby forming a sizing composition;

wherein the alkenylsuccinic anhydride and the starch in the emulsion and the second starch component are present at a starch:alkenylsuccinic anhydride weight ratio that is sufficiently high to enable the sizing composition to impart useful sizing properties to a fibrous substrate when the sizing composition contacts the-fibrous substrate; and wherein the starch component of the starch: alkenylsuccinic anhydride weight ratio is the total weight of the first starch component and the second starch component.

11. A process for making a sizing composition comprising the sequential steps of:

(a) emulsifying alkenylsuccinic anhydride with a first starch component containing starch selected from the group consisting of non-ionic starches, anionic starches, and mixtures thereof, and thereby forming an emulsion; wherein the first starch component contains starch consisting of the product of modifying a corn starch, potato starch, wheat starch, tapioca starch, or sorghum starch by a process selected from oxidation, acid modification, heat treatment, acetylation, and hydroxyethylation; wherein said emulsifying alkenylsuccinic anhydride with a first starch component is conducted using an emulsification device characterized by an inlet temperature of about 120 to 150° F. and an inlet pressure of about 10 psig; and (b) combining the emulsion with a second starch component selected from the group consisting of non-ionic starches, ionic starches, and mixtures thereof, and thereby forming a sizing composition;

wherein the alkenylsuccinic anhydride and the starch in the emulsion and the second starch component are present at a starch:alkenylsuccinic anhydride weight ratio that is sufficiently high to enable the sizing composition to impart useful sizing properties to a fibrous substrate when the sizing composition contacts the-fibrous substrate; and wherein the starch component of the starch: alkenylsuccinic anhydride weight ratio is the total weight of the first starch component and the second starch component.

12. A process for making a sizing composition comprising the sequential steps of:

(a) emulsifying alkenylsuccinic anhydride with a first starch component containing starch selected from the group consisting of non-ionic starches, anionic starches, and mixtures thereof, and thereby forming an emulsion; wherein the first starch component contains starch consisting of the product of modifying a corn starch, potato starch, wheat starch, tapioca starch, or sorghum starch by a process selected from oxidation, acid modification, heat treatment, acetylation, and hydroxyethylation; wherein said emulsifying alkenylsuccinic anhydride with a first starch component is conducted using an emulsification device characterized by an outlet temperature of about 130 to 160° F. and an outlet pressure of about 150 to about 160 psig; and (b) combining the emulsion with a second starch component selected from the group consisting of non-ionic starches, ionic starches, and mixtures thereof, and thereby forming a sizing composition;

wherein the alkenylsuccinic anhydride and the starch in the emulsion and the second starch component are present at a starch:alkenylsuccinic anhydride weight ratio that is sufficiently high to enable the sizing composition to impart useful sizing properties to a fibrous substrate when the sizing composition contacts the-fibrous substrate; and wherein the starch component of the starch: alkenylsuccinic anhydride weight ratio is the total weight of the first starch component and the second starch component.

* * * * *